US008381675B2

(12) United States Patent
Pei

(10) Patent No.: US 8,381,675 B2
(45) Date of Patent: Feb. 26, 2013

(54) LENS BARREL COATING AID APPARATUS

(75) Inventor: Shao-Kai Pei, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 347 days.

(21) Appl. No.: 12/891,768

(22) Filed: Sep. 27, 2010

(65) Prior Publication Data

US 2011/0283938 A1 Nov. 24, 2011

(30) Foreign Application Priority Data

May 24, 2010 (TW) ..... 99116442 A

(51) Int. Cl.
*B05C 13/00* (2006.01)
*B05C 13/02* (2006.01)
*B05C 21/00* (2006.01)

(52) U.S. Cl. ..... 118/500; 118/505; 118/503

(58) Field of Classification Search ..... 118/500, 118/503, 504, 505; 414/737, 751.1, 755
See application file for complete search history.

(56) References Cited

U.S. PATENT DOCUMENTS

| | | | | |
|---|---|---|---|---|
| 5,509,191 | A * | 4/1996 | Best | 29/722 |
| 6,305,729 | B1 * | 10/2001 | Mukasa | 414/752.1 |
| 2002/0075661 | A1 * | 6/2002 | Ambe | 361/760 |
| 2007/0237621 | A1 * | 10/2007 | Wu | 414/755 |
| 2008/0291558 | A1 * | 11/2008 | Huang | 359/830 |
| 2010/0238550 | A1 * | 9/2010 | Chen | 359/503 |

* cited by examiner

*Primary Examiner* — Dah-Wei Yuan
*Assistant Examiner* — Binu Thomas
(74) *Attorney, Agent, or Firm* — Altis Law Group, Inc.

(57) ABSTRACT

A lens barrel coating aid apparatus includes a holder, a suction component and a suction source. The holder includes a holding surface, securing portions positioned on the holding surface to fix lens barrels, and a first positioning portion. The first positioning portions are formed on the holding surface, and spaced from the securing portions. The suction component includes a suction surface facing the holding surface and a second positioning portion corresponding to the first positioning portion. Suction holes are defined on the suction surface corresponding to the securing portions. The suction holes are configured to suck plugs to insert into or pull out of the lens barrels. The second positioning portions are formed on the suction surface, and spaced from the suction holes. The suction source is connected with the suction holes, and provides suction force to the suction holes.

11 Claims, 5 Drawing Sheets

LENS BARREL COATING AID APPARATUS

BACKGROUND

1. Technical Field

The present disclosure relates to aid apparatuses and, particularly, to a lens barrel coating aid apparatus.

2. Description of Related Art

Generally, an electrically conductive coating needs to be coated on the outer surface of a lens barrel for implementing EMI shielding. Before coating, the worker first lays out a batch of the lens barrels on a holder, and then inserts a plug into each lens barrel to prevent the inner surface of the lens barrels from being contaminated in the coating process. The worker then pulls out the plugs from the lens barrels after the coating process of the lens barrels are completed. If there are many batches of the lens barrels to be coated, the worker has to repeatedly insert the plugs into and pull the plugs out from the lens barrels manually. That is an inefficient process for the coating process.

What is needed, therefore, is an lens barrel coating aid apparatus to overcome the above-described problem.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments.

DETAILED DESCRIPTION

Embodiments of the present disclosure will now be described in detail below, with reference to the accompanying drawings.

Figure 1:
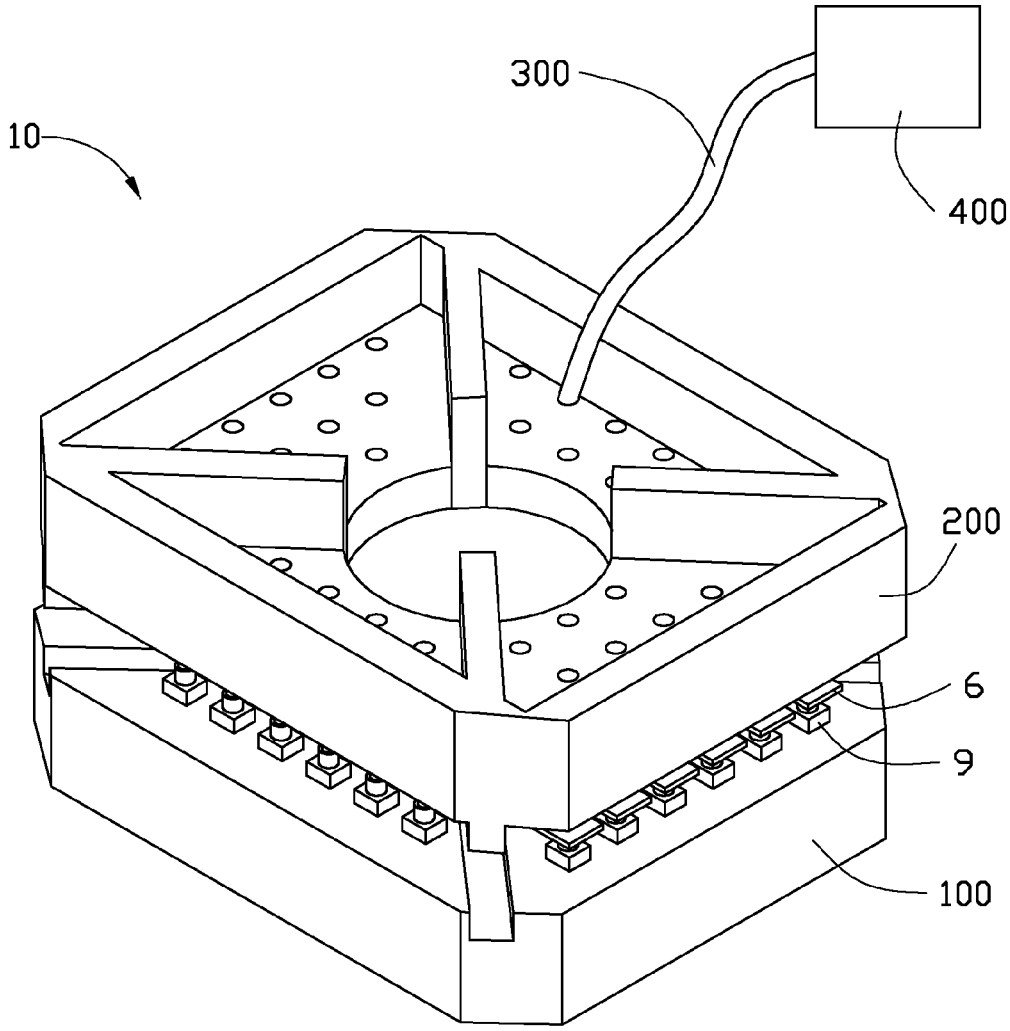
FIG. 1 is a schematic view of an lens barrel coating aid apparatus according to an exemplary embodiment.

Referring to FIG. 1, an aid apparatus 10 for coating a lens barrel, according to an exemplary embodiment, is shown. The aid apparatus 10 is used for inserting a number of plugs 6 into a number of lens barrels 9 to prevent the lens barrels 9 from being contaminated in a coating process.

Figure 2:
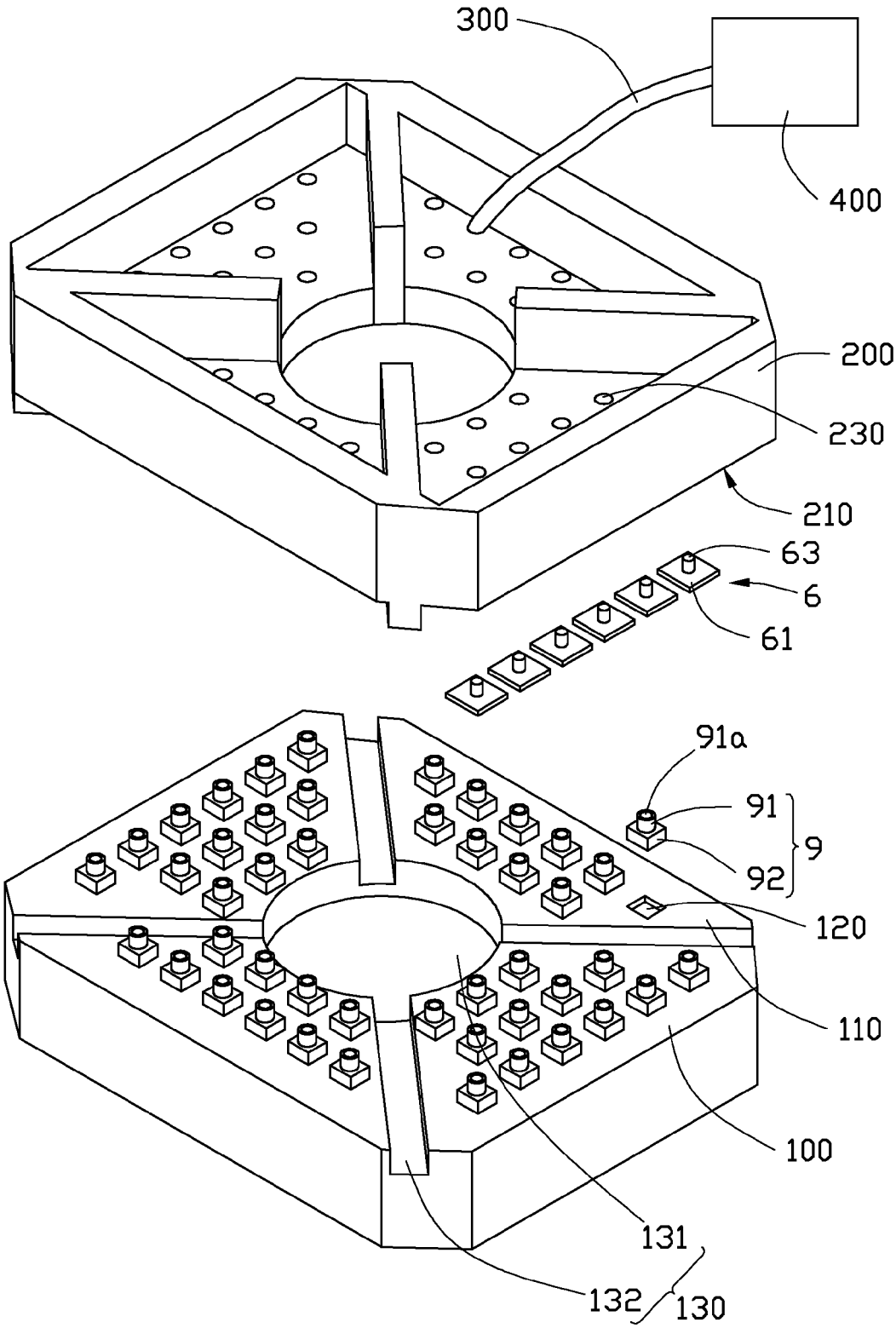
FIG. 2 is a partial exploded view of the aid apparatus of FIG. 1.
Figure 3:
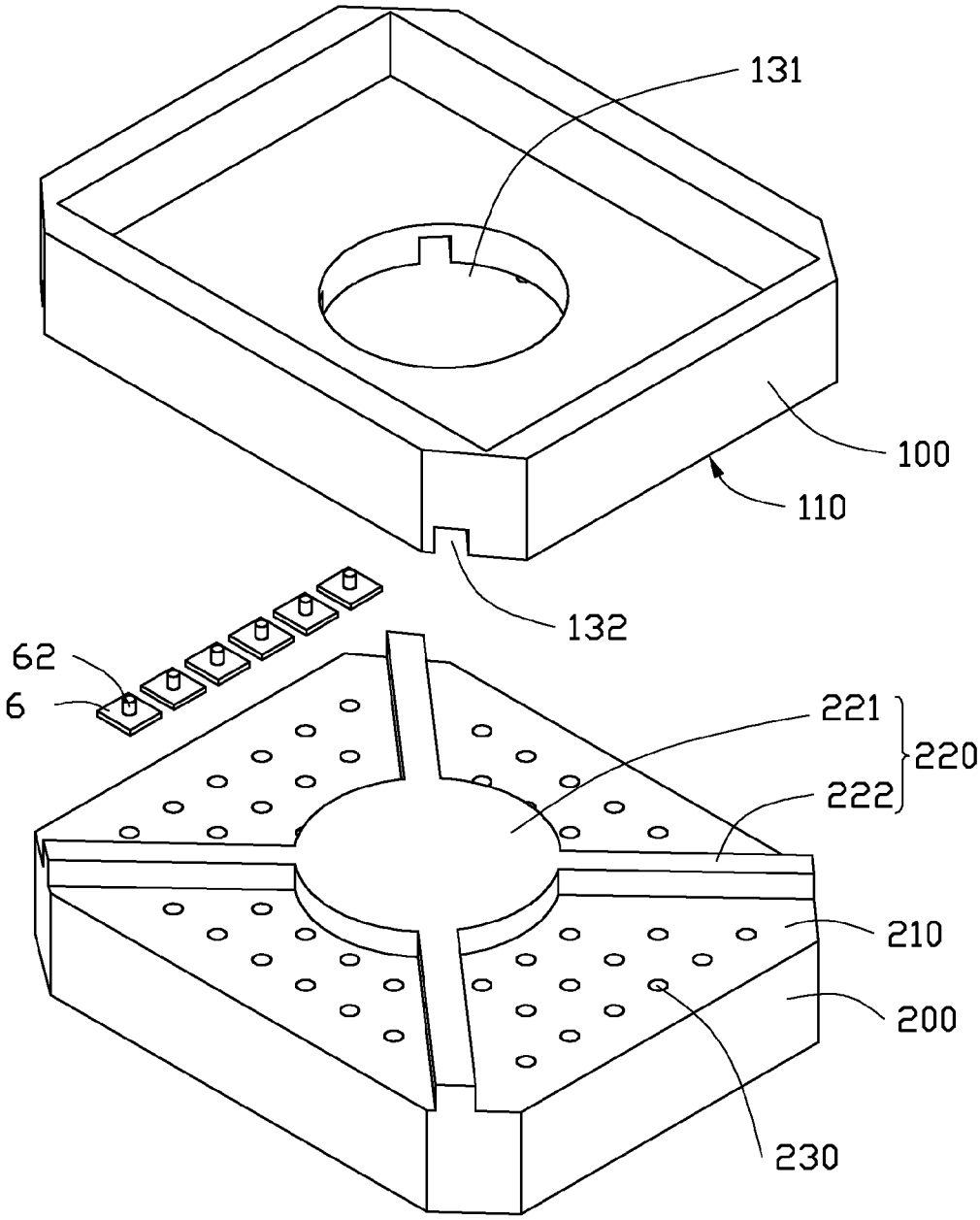
FIG. 3 is similar to FIG. 2, but showing the aid apparatus inverted.

Referring to FIGS. 2 and 3, the lens barrel 9 includes a lens barrel body 91 and a base 92. The lens barrel body 91 defines a cavity 91*a* for receiving a lens therein. The base 92 is positioned at one end of the lens barrel body 91 and communicates with the lens barrel body 91. The plug 6 includes a plug body 61, a plugging portion 62, and a holding portion 63. The plugging portion 62 and the holding portion 63 are positioned at two opposite ends of the plug body 61. The plug body 61 is a plate-shaped structure. The plugging portion 62 engages with the cavity 91*a* to prevent the coating material from entering into the cavity 91*a*. The plugging portion 62 and the holding portion 63 are cylindrical.

The aid apparatus 10 includes a holder 100, a suction component 200, a tube 300, and a suction source 400. The holder 100 includes a holding surface 110, a number of securing portions 120, and a first positioning portion 130. The securing portions 120 and the first positioning portion 130 are positioned on the holding surface 110, and spaced from each other. In the present embodiment, the first positioning portion 130 is defined in the holding surface 110 and separates the holding surface 110 into four portions. The securing portions 120 are positioned on the four portions. The first positioning portion 130 defines a first groove 131 and four second grooves 132. The first groove 131 is round, and positioned at the center of the holder 100. The second grooves 132 are all rectangular, and symmetrically arrayed around the first groove 131 along radial directions of the first groove 131. In the present embodiment, the second grooves 132 are arrayed to form a symmetric X-shape.

The securing portion 120 is a receiving hole used for firmly receiving the base 92 of the lens barrel 9. In other embodiments, the securing portion 120 can be a protruding post to firmly insert into the base 92 of the lens barrel 9.

The suction component 200 includes a suction surface 210 and a second positioning portion 220. The suction surface 210 faces to the holding surface 110 of the holder 100. The suction surface 210 defines a number of suction holes 230 corresponding to the securing portions 120.

The suction hole 230 and the second positioning portion 220 are positioned on the suction surface 210, and spaced from each other. The second positioning portion 220 corresponds to the first positioning portion 130. The suction surface 210 is separated into four portions by the second positioning portion 220. The suction holes 230 are positioned on the four portions. The second positioning portion 220 is used for engaging with the first positioning portion 130. In the present embodiment, the second positioning portion 220 includes a first block 221 and four second blocks 222. The first block 221 is a cylinder, and positioned at the center of the suction component 200. The first block 221 engages with the first groove 131. The second blocks 222 are all cuboid, and symmetrically arrayed around the first block 221. In the present embodiment, the second blocks 222 are symmetrically arrayed around the first block 221 along radial directions of the first block 221 to form a symmetric X-shape. The second blocks 222 engage with the second grooves 132 to align the suction holes 230 with the corresponding securing portions 120. In other embodiments, the structure of the first positioning portion 130 and the second positioning portion 220 can be reversed.

Each suction hole 230 is aligned with the corresponding securing portion 120 when the suction component 200 is stacked on the holder 100 and the second positioning portions 220 aligns with the first positioning portions 130. The suction hole 230 engages with the holding portion 63 of the plug 6. In the present embodiment, the suction hole 230 is round. The suction hole 230 is used to apply suction to maintain positioning of the holding portion 63 of the plug 6.

In the present embodiment, the tube 300 is a flexible round tube. In other embodiments, the cross-section of the tube 300 can be oval or other shapes. The number of the tube 300 is the same as that of the suction holes 230. Only one tube 300 is shown in the drawings, the others are not shown. Each tube 300 is communicated to the corresponding suction hole 230.

The suction source 400 is communicated to the tube 300. The suction source 400 can be a vacuum apparatus, such as a vacuum pump. The suction source 400 is capable of providing different vacuum levels to make the suction hole 230 to retain or release the plug 6.

Figure 4:
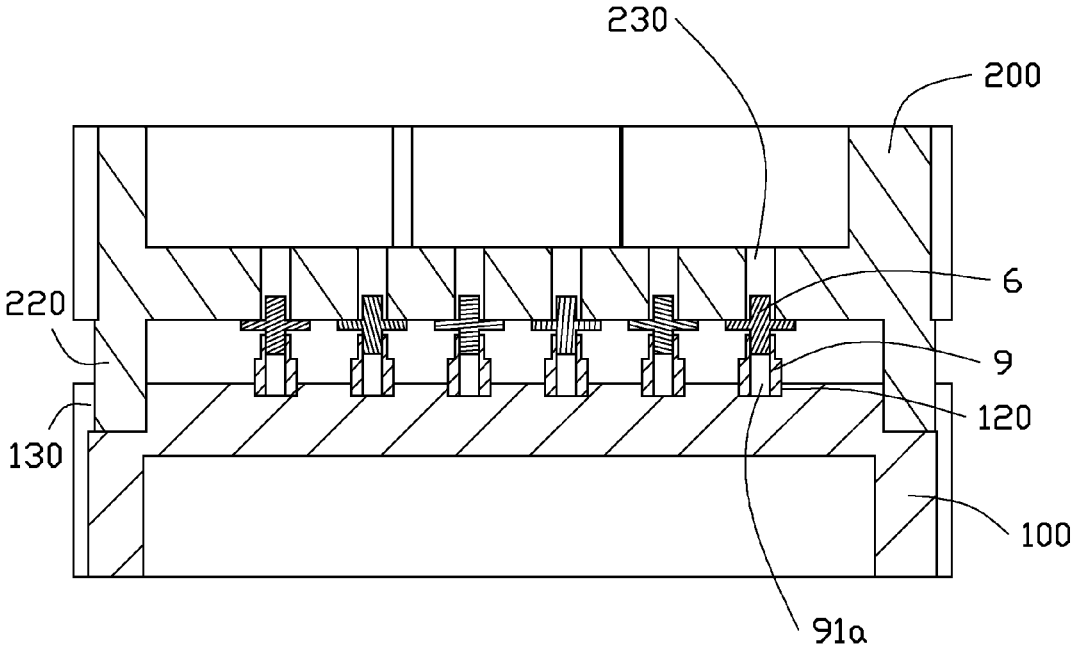
FIG. 4 is a cross-sectional view of the aid apparatus of FIG. 1, a number of plugs inserted into the corresponding lens barrels by the aid apparatus for coating.
Figure 5:
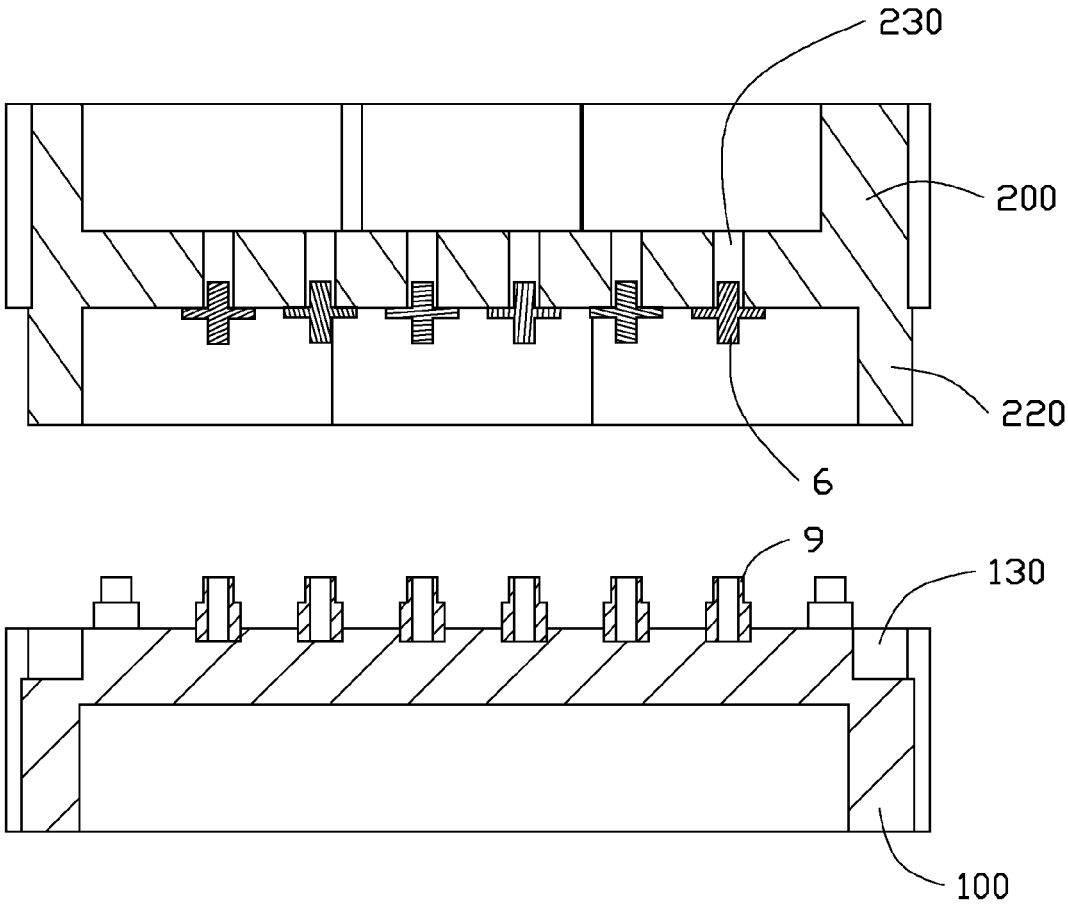
FIG. 5 is similar to FIG. 4, but showing the plugs pulled out from the lens barrels by the aid apparatus.

Referring to FIGS. 4 and 5, in an inserting process, the lens barrels 9 are inserted into the securing portions 120, and the plugs 6 are inserted into and sucked in the suction holes 230.

The plugs 6 are aligned with the corresponding lens barrels 9 on the holder 100 by aligning the second positioning portion 220 of the suction component 200 with the first positioning portion 130 of the holder 100. Then, the plug 6 is pressed into the cavity 91*a* of the lens barrels 9 by moving the suction component 200 down. At last, the suction force is discontinued from the suction holes 230, thereby the suction component 200 is held into position. In this way, the lens barrels 9 are ready for coating process.

After completing the coating process, the suction holes 230 are aligned with the corresponding lens barrels 9 on the holder 100 by aligning the second positioning portion 220 of the suction component 200 with the first positioning portion 130 of the holder 100. Then, the suction component 200 is moved down to make the suction holes 230 receive the plugs 6. The suction source 400 applies vacuums to the suction holes 230 to apply vacuum on the plugs 6 to maintain their position. Finally, the suction component 200 is lifted to pull out the plugs 6 from the lens barrels 9. The coated lens barrels 9 are replaced by a new batch of lens barrels for a next coating process. But the plugs 6 on the suction component 200 need not be arrayed again. That will increase the coating efficiency.

While certain embodiments have been described and exemplified above, various other embodiments will be apparent to those skilled in the art from the foregoing disclosure. The present disclosure is not limited to the particular embodiments described and exemplified, and the embodiments are capable of considerable variation and modification without departure from the scope of the appended claims.

What is claimed is:

1. A lens barrel coating aid apparatus, comprising:

a holder comprising:

a holding surface;

a plurality of securing portions positioned on the holding surface to fix a plurality of lens barrels; and a first positioning portion positioned on the holding surface, and spaced from the securing portions;

a suction component comprising:

a suction surface facing the holding surface, wherein a plurality of suction holes is defined on the suction surface, the suction holes correspond to the securing portions and are configured for sucking a plurality of plugs to insert into or pull out of the lens barrels; and a second positioning portion positioned on the suction surface and corresponding to the first positioning portion, the second positioning portion spaced from the suction holes and aligned with the first positioning portion to align the suction holes with the securing portions; and a suction source connected to the suction holes for providing suction force, wherein the first positioning portion defines a first groove and a plurality of second grooves, the second positioning portion comprises a first block and a plurality of second blocks, the first block corresponds to the first groove, and the second blocks correspond to the second grooves.

2. The lens barrel coating aid apparatus as claimed in claim 1, wherein the securing portion is selected from one of a receiving hole and a protruding post.

3. The lens barrel coating aid apparatus as claimed in claim 1, wherein the first positioning portion is a groove defined in the holding surface, and the second positioning portion is a block engaged with the groove.

4. The lens barrel coating aid apparatus as claimed in claim 1, wherein the first groove is positioned at the center of the holder, the second grooves are symmetrically arrayed around the first groove, first block is positioned at the center of the suction surface, the second blocks are symmetrically arrayed around the first block.

5. The lens barrel coating aid apparatus as claimed in claim 4, wherein the first groove is round, the second grooves are arrayed along radial directions of the first groove, the first block is cylindrical, the second blocks are symmetrically arrayed around the first block along radial directions of the first block.

6. The lens barrel coating aid apparatus as claimed in claim 5, wherein the second grooves are all rectangular, the second blocks are all cuboid.

7. The lens barrel coating aid apparatus as claimed in claim 1, wherein the suction hole is round.

8. The lens barrel coating aid apparatus as claimed in claim 1, wherein the suction source is a vacuum pump.

9. The lens barrel coating aid apparatus as claimed in claim 1, further comprising a plurality of tubes connected between the suction holes and the suction source.

10. The lens barrel coating aid apparatus as claimed in claim 9, wherein each of the plurality of tubes is a flexible round tube.

11. The lens barrel coating aid apparatus as claimed in claim 1, wherein the suction source is capable of providing different vacuum levels.

* * * * *